US007896984B2

(12) United States Patent
Kobayashi et al.

(10) Patent No.: US 7,896,984 B2
(45) Date of Patent: Mar. 1, 2011

(54) METHOD FOR MANUFACTURING SEAMLESS STEEL PIPE FOR LINE PIPE

(75) Inventors: Kenji Kobayashi, Nishinomiya (JP); Tomohiko Omura, Kishiwada (JP); Kunio Kondo, Sanda (JP); Yuji Arai, Amagasaki (JP); Nobuyuki Hisamune, Kinokawa (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/071,517

(22) Filed: Feb. 21, 2008

(65) Prior Publication Data

US 2008/0216928 A1 Sep. 11, 2008

Related U.S. Application Data

(63) Continuation of application No. PCT/JP2006/316398, filed on Aug. 22, 2006.

(30) Foreign Application Priority Data

Aug. 22, 2005 (JP) ..... 2005-240069

(51) Int. Cl.
*C21D 8/10* (2006.01)
*C21D 9/08* (2006.01)

(52) U.S. Cl. ..... 148/590; 148/663; 420/105

(58) Field of Classification Search ..... 148/519, 148/520, 521, 559, 570, 590, 636–638, 660, 148/662, 320–337, 909; 420/84, 89–92, 104–106, 108, 109, 110–112, 119–121, 123, 124, 126, 127

See application file for complete search history.

(56) References Cited

FOREIGN PATENT DOCUMENTS

| | | |
|---|---|---|
| EP | 1 025 272 | 6/2006 |
| EP | 1 876 254 | 1/2008 |
| JP | 61-147812 | 7/1986 |
| JP | 8-269544 | 10/1996 |
| JP | 09-235617 | * 9/1997 |
| JP | 09-287029 | 11/1997 |
| JP | 09-324216 | 12/1997 |
| JP | 11-189840 | 7/1999 |
| JP | 2004-124158 | * 4/2004 |
| JP | 09-324217 | 12/2007 |

* cited by examiner

*Primary Examiner* — George Wyszomierski
*Assistant Examiner* — Mark L Shevin
(74) *Attorney, Agent, or Firm* — Clark & Brody

(57) ABSTRACT

A seamless steel pipe for line pipe having high strength and stable toughness and having resistance to sulfide corrosion cracking at low temperatures to room temperature is provided. A seamless steel pipe according to the present invention has a chemical composition comprising, in mass percent, C: 0.03-0.08%, Si: 0.05-0.5%, Mn: 1.0-3.0%, Mo: greater than 0.4% to 1.2%, Al: 0.005-0.100%, Ca: 0.001-0.005%, a remainder of Fe and impurities including N, P, S, O, and Cu, with the impurities containing at most 0.01% of N, at most 0.05% of P, at most 0.01% of S, at most 0.01% of O, and at most 0.1% of Cu, and having a microstructure comprising a bainitic-martensitic dual phase structure.

3 Claims, 2 Drawing Sheets

METHOD FOR MANUFACTURING SEAMLESS STEEL PIPE FOR LINE PIPE

This application is a continuation of International Patent Application No. PCT/JP2006/316398, filed Aug. 22, 2006. This PCT application was not in English as published under PCT Article 21(2).

TECHNICAL FIELD

This invention relates to a seamless steel pipe for use as line pipe having improved strength, toughness, and corrosion resistance. A seamless steel pipe according to the present invention has a strength of X80 grade specified by API (American Petroleum Institute) standards and specifically a strength of 80-95 ksi (a yield strength of 551-655 MPa), and it also has good toughness and corrosion resistance, particularly good resistance to sulfide stress cracking even at low temperatures. Therefore, the seamless steel pipe is suitable for use as a high strength, high toughness, thick-walled seamless steel pipe for line pipe particularly for use in low-temperature environments. For example, it can be used as steel pipe for line pipe to be used in cold regions, as steel pipe for sea floor flow lines, and as steel pipe for risers.

BACKGROUND ART

In recent years, since crude oil and natural gas resources in oil fields located on land or in so-called shallow seas having a water depth of up to around 500 meters are being depleted, development of offshore oil fields in so-called deep seas at a depth of 1,000-3,000 meters, for example, beneath the surface of the sea is being actively carried out. In deep-sea oil fields, it is necessary to transfer crude oil or natural gas from the wellhead of an oil well or natural gas well which is installed on the sea floor to a platform located on the surface using steel pipes referred to as flow lines or risers.

In steel pipes constituting flow lines or risers installed deep in the sea, a high internal fluid pressure to which the pressure of deep underground layers is added is applied to the interior of the pipes, and they also undergo the effects of water pressure of the deep sea when operation is stopped. In addition, steel pipes constituting risers are subjected to the effect of repeated strains due to waves. Furthermore, the sea water temperature deep in the sea falls to around 4° C.

Flow lines are steel pipes for transport which are installed along the contours of the ground or the sea floor. A riser is a steel pipe for transport which rises from the sea floor to a platform on the surface of the sea. When such pipes are used in deep sea oil fields, it is normally considered necessary for the wall thickness of such steel pipes to be at least 30 mm, and in actual practice, it is customary to use thick-walled pipes with a wall thickness of 40-50 mm. From this fact, it can be seen that flow lines and risers are members which are used in severe conditions.

The fluid produced in oil wells and gas wells in deep sea being developed in recent years often contain hydrogen sulfide, which is corrosive. In such environments, high strength steel undergoes hydrogen embrittlement referred to as sulfide stress cracking (SSC) and eventually undergoes failure. In the past, susceptibility to SSC was said to be highest at room temperature, so a corrosion resistance test for evaluating resistance to SSC was carried out in a room temperature environment. However, it has been found that in actuality, susceptibility to sulfide stress cracking is higher and cracking occurs more easily in a low-temperature environment of around 4° C. than at room temperature.

In a steel pipe for line pipe used as flow lines or risers, a material is desired which exhibits not only high strength and high toughness but also good corrosion resistance in a sulfide-containing environment. In this type of application, seamless steel pipe is used rather than welded pipe in order to achieve high reliability.

Corrosion resistance of steel for line pipe has hitherto placed stress on prevention of hydrogen induced cracking (HIC), i.e., on resistance to HIC. Among corrosion resistant steel pipes having a strength exceeding X80 which have been disclosed so far, there are many which emphasize HIC resistance. For example, JP 09-324216 A1, JP 09-324217 A1, and JP 11-189840 A1 disclose steels for line pipe of X80 grade having excellent HIC resistance. With these materials, HIC resistance is improved by controlling inclusions in the steel and increasing hardenability. However, with respect to resistance to SSC, there are no discussions therein concerning resistance to SSC at room temperature, not to mention resistance to SSC at low temperatures.

As described above, as the development of oil wells and gas wells in deep sea oil fields proceeds, the resistance to SSC of steel pipes for line pipes used as flow lines or risers is becoming important. In a low-temperature environment such as in deep sea oil or gas fields, susceptibility to SSC of high strength steels increases, and particularly with high strength steels having a yield strength (YS) of at least 80 ksi (551 MPa), susceptibility to SSC increases to an extent which cannot be ignored. Therefore, there is a demand for improvement in resistance to SSC in seamless steel pipes for line pipe made from high strength steels of at least X80.

DISCLOSURE OF THE INVENTION

The object of the present invention is to provide a seamless steel pipe for line pipe having a high strength with stable toughness and good resistance to SSC, in particular good resistance to SSC in low-temperature environments, and a method for its manufacture.

The present inventors investigated susceptibility to SSC at room temperature and low temperatures of various steel materials, and they found that susceptibility to SSC was higher at low temperatures than at room temperature for all of the materials. Following up on this result, they performed investigations based on the premise that good resistance to SSC at low temperatures cannot be obtained by conventional materials aimed at improving resistance to SSC at room temperature, and that a new material design is necessary in order to improve resistance to SSC at low temperatures. As a result, they identified the chemical composition and microstructure of a material exhibiting good resistance to SSC not only at room temperature but also at low temperatures.

In a conventional high strength, low alloy steel for line pipe in which the chemical composition is selected so as to increase hardenability and the cooling speed is increased in order to obtain a high strength through hardening, even if it is possible to improve corrosion resistance at room temperature and particularly resistance to SSC, corrosion resistance in a low-temperature environment is not improved. Upon investigation of the chemical composition of steel and the influence of a cooling speed with the object of improving corrosion resistance at low temperatures, it was found that resistance to SSC at low temperatures is astonishingly improved by adding Mo in order to increase hardenability and temper softening resistance and by decreasing the cooling speed, resulting in the formation of a bainitic-martensitic dual phase structure.

The present invention is a seamless steel pipe for line pipe having improved resistance to sulfide stress cracking at low temperatures characterized by having a chemical composition comprising, in mass percent, C: 0.03-0.08%, Si: 0.05-0.5%, Mn: 1.0-3.0%, Mo: greater than 0.4% to 1.2%, Al: 0.005-0.100%, Ca: 0.001-0.005%, a remainder of Fe and impurities including N, P, S, O, and Cu in which the contents of impurities are at most 0.01% for N, at most 0.05 for P, at most 0.01% for S, at most 0.01% for O (oxygen), and at most 0.1% for Cu, and having a yield strength (YS) of at least 80 ksi (551 MPa) and a stress intensive factor $K_{ISSC}$ of at least 20.1 ksi-(in)$^{1/2}$ (=ksi√in) as calculated from the results of a test performed in an environment at 4° C. according to the DCB test method specified in NACE TM0177-2005 method D.

The above-described chemical composition may further contain one or more elements selected from Cr: at most 1.0%, Nb: at most 0.1%, Ti: at most 0.1%, Zr: at most 0.1%, Ni: at most 2.0%, V: at most 0.2%, and B: at most 0.005%.

A value $K_I$ of stress intensive factor obtained from a DCB test is an index of is the minimum value of K (intensity of stress field at the tip of a crack) capable of allowing a crack to grow under a given corrosive environment. It indicates that the greater the value, the lower the susceptibility to cracking in the given corrosive environment.

In the present invention, the resistance to sulfide stress cracking (resistance to SSC) of a steel is evaluated by a DCB (Double Cantilever Beam) test which is carried out in accordance with NACE (National Association of Corrosion Engineers) TM0177-2005 method D, and a stress intensive factor $K_{ISSC}$ in a sulfide corrosive environment is calculated from the measured values of the test. The test bath was an aqueous 5 wt % sodium chloride+0.5 wt % acetic acid solution saturated with 1 atm. of hydrogen sulfide gas at a low temperature (4° C.).

A specimen into which a prescribed wedge is inserted along the longitudinal center line of the specimen, thereby imposing stress in the directions that the resulting two arms open (namely in the directions that the crack extend at the root of the arms), is immersed for 336 hours in the test bath. The stress intensive factor $K_{ISSC}$ is calculated by the following equation based on the extended crack length a and the wedge releasing stress P.

$$K_{ISSC} = \frac{Pa(2\sqrt{3} + 2.38h/a)(B/B_n)^{1/\sqrt{3}}}{Bh^{3/2}} \quad \text{[Equation 1]}$$

where B is the thickness of the specimen, h is the width of each of the two arms on both sides of the crack, and $B_n$ is the thickness of the portion of the specimen in which the crack propagates.

The simplified model shown in FIG. 4 is used for further explanation. Assuming that a material having infinite dimensions has an initial crack (or a defect formed by corrosion) having a depth a, when a stress σ is imposed on the material in the directions that the crack opens as shown by the arrows, the stress intensity factor $K_I$ is expressed by the following equation:

$$K_I = \sigma\sqrt{\pi a} \times 1.1215 [= \sigma(\pi a)^{1/2} \times 1.1215]$$

Thus, the deeper the initial crack and the higher the stress imposed, the larger is the value of $K_I$. The depth of the initial crack can be estimated to be at most 0.5 mm. As to the stress which is imposed, in view of the strength of X 80 grade steels specified by API which is 80-95 ksi (551-655 MPa) in yield strength (YS), a stress is which is generally imposed in a corrosion resistance test is 90% of the YS, which is calculated at 72-85.5 ksi (496-590 MPa). The value of $K_I$ corresponding to such stress value is calculated to be 20.1 ksi-(in)$^{1/2}$ [22.1 MPa-(m)$^{1/2}$]–23.9 ksi-(in)$^{1/2}$ [26.2 MPa-(m)$^{1/2}$].

A seamless steel pipe for line pipe according to the present invention has a value of stress intensive factor $K_{ISSC}$ at 4° C. is at least 20.1 ksi-(in)$^{1/2}$[22.1 MPa-(m)$^{1/2}$]. This means that the seamless steel pipe has improved resistance to SSC which is sufficient to prevent the occurrence of sulfide corrosion cracking in a standard SSC resistance test for X80 grade steels even at a low temperature at which the susceptibility to SSC is higher than at room temperature. The value of $K_{ISSC}$ at 4° C. is preferably at least 23.9 ksi-(in)$^{1/2}$2[26.2 MPa-(m)$^{1/2}$]. In this case, an extremely high resistance to SSC is achieved whereby cracking is prevented even in a SSC resistance test in which the load imposed is 90% of the maximum strength of X80 grade steels (95 ksi in YS).

From another standpoint, the present invention is a method of manufacturing a seamless steel pipe for line pipe comprising forming a seamless steel pipe by hot working from a steel billet having the above-described chemical composition and subjecting the steel pipe to quenching at a cooling rate of at most 20° C. per second followed by tempering.

As used here, "cooling rate" for quenching means the average cooling rate at the center of the pipe wall thickness in the temperature range from 800° C. to 500° C.

The quenching may be carried out by first cooling the seamless steel pipe prepared by hot working and then reheating it, or it can be performed thereon immediately after the formation of the seamless steel pipe by hot working. Tempering is preferably carried out at a temperature of at least 600° C.

According to the present invention, by prescribing the chemical composition, i.e., the steel composition, and the manufacturing method of a seamless steel pipe in the above manner, a seamless steel pipe for line pipe which has a high strength of X80 grade (a yield strength of at least 551 MPa) and stable toughness and which has good resistance to SSC at low temperatures so that it can be used in a low-temperature environment containing hydrogen sulfide such as deep sea oil fields can be manufactured just by heat treatment in the form of quenching and tempering even in the case of a thick-walled seamless steel pipe having a thickness of at least 30 mm.

As used here, "line pipe" means a tubular structure which is used for transport of a fluid such as crude oil or natural gas and which may of course be used on land, as well as on the sea or in the sea. A seamless steel pipe according to the present invention is particularly suitable for use as line pipe such as flow lines or risers installed on or in deep seas and as line pipe installed in cold regions. However its applications are not restricted to these.

There are no particular restrictions on the shape and dimensions of a seamless steel pipe according to the present invention, but there are limits on the dimensions of a seamless steel pipe due to its manufacturing process, and normally its outer diameter is a maximum of around 500 mm and a minimum of around 150 mm. The wall thickness of the steel pipe is often at least 30 mm (such as 30-50 mm) in the case of flow lines and risers, but in the case of line pipe used on land, it may be much thinner pipe such as a pipe having a thickness of 5-30 mm and typically around 10-25 mm.

A seamless steel pipe for line pipe according to the present invention has sufficient mechanical properties and corrosion resistance for use as risers and flow lines particularly in deep sea oil fields which may contain hydrogen sulfide and are at a low temperature, so it has practical significance in that it greatly contributes to stable supply of energy.

BEST MODE FOR CARRYING OUT THE INVENTION

Figure 1:
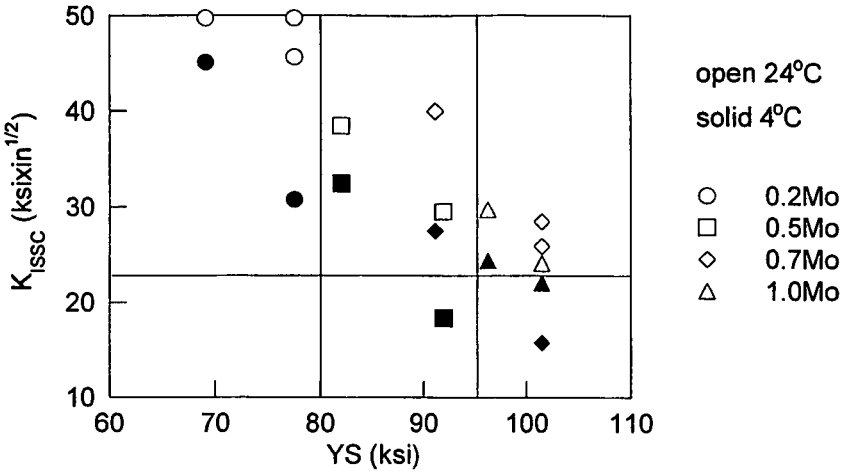
FIG. 1 is a graph showing the effect of the Mo content of steel on the yield strength (YS) and the stress intensive factor ($K_{ISSC}$).

The reasons for prescribing the chemical composition of a steel pipe according to the present invention in the above manner will be described. As mentioned previously, percent with respect to the content (concentration) of chemical components means mass percent.

C: 0.03-0.08%

C is necessary in order to increase the hardenability of steel and thus increase its strength, and it is made at least 0.03% in order to obtain sufficient strength. If too much C is contained, the toughness of steel decreases, so its upper limit is made 0.08%. The C content is preferably at least 0.04% and at most 0.06%.

Si: 0.05-0.5%

Si is an element which is effective for deoxidation of steel. It is necessary to add at least 0.05% of Si as the minimum amount necessary for deoxidation. However, Si has the effect of decreasing the toughness of a weld heat affected zone at the time of circumferential welding to connect line pipes, and thus its content is preferably as small as possible. The addition of 0.5% or more of Si causes the toughness of steel to markedly decrease and promotes the precipitation of a ferrite phase which is a softened phase, thereby decreasing the resistance to SSC of the steel. Therefore, the upper limit on the Si content is made 0.5%. The Si content is preferably at most 0.3%.

Mn: 1.0-3.0%

It is necessary to add a certain amount of Mn in order to increase the hardenability and thus strength of steel and to ensure its toughness. If its content is less than 1.0%, these effects are not obtained. However, since an excessively high Mn content results in a decrease in the resistance to SSC of steel, its upper limit is made 3.0%. In view of toughness, the lower limit on the Mn content is preferably made 1.5%.

P: at most 0.05%

P is an impurity which segregates at grain boundaries and causes a decrease in resistance to SSC. This effect becomes marked if its content exceeds 0.05%, so its upper limit is made 0.05%. The content of P is preferably made as low as possible.

S: at most 0.01%

Like P, S also segregates at grain boundaries and causes a decrease in resistance to SSC. If its content exceeds 0.01%, this effect becomes marked, so its upper limit is made 0.01%. The content of S is preferably made as low as possible.

Mo: greater than 0.4% to 1.2%

Mo is an important element which can increase the hardenability of steel and thus increase its strength and which at the same time increases the resistance to temper softening of the steel, thereby making high temperature tempering possible to increase toughness. In order to obtain this effect, it is necessary for the content of Mo to exceed 0.4%. A more preferred lower limit is 0.5%. The upper limit on Mo is made 1.2% because Mo is an expensive element and the increase in toughness saturates.

Al: 0.005-0.100%

Al is an element which is effective for deoxidation of steel, but this effect cannot be obtained if its content is less than 0.005%. Even if its content exceeds 0.100%, its effect saturates. A preferred range for the Al content is 0.01-0.05%. The content of Al in the present invention is indicated by acid soluble Al (referred to as sol. Al).

N: at most 0.01%

N (nitrogen) is present in steel as an impurity. If its content exceeds 0.01%, coarse nitrides are formed, thereby decreasing the toughness and resistance to SSC of steel. Accordingly, its upper limit is made 0.01%. The content of N (nitrogen) is preferably made as low as possible.

O: at most 0.01%

O (oxygen) is present in steel as an impurity. If its content exceeds 0.01%, it forms coarse oxides, thereby decreasing the toughness and resistance to SSC of steel. Accordingly, its upper limit is made 0.01%. The content of O (oxygen) is preferably made as low as possible.

Ca: 0.001-0.005%

Ca is added with the object of improving the toughness and corrosion resistance of steel by controlling the form of inclusions and with the object of improving casting properties by suppressing nozzle clogging at the time of casting. In order to obtain these effects, at least 0.001% of Ca is added. If too much Ca is added, inclusions easily form clusters, and toughness and corrosion resistance decrease, so its upper limit is made 0.005%.

Cu: at most 0.1% (impurity)

Cu is an element which generally increase the corrosion resistance of steel, but it has been found that when Cu is added together with Mo, it decreases the resistance to SSC of steel and that this influence of Cu is marked particularly in a low temperature environment. Since a seamless steel pipe for line pipe according to the present invention contains Mo in a larger amount than usual as described above and is expected for use in a low temperature environment, Cu is not added in order to ensure the resistance to SSC of steel. However, Cu is an element which has the possibility of a slight amount being included in steel as an impurity in a steel making process. Therefore, it is controlled so as to have a content of at most 0.1% which does not produce any substantial adverse effect on corrosion resistance when present along with Mo.

The strength, toughness, and/or corrosion resistance of a seamless steel pipe for line pipe according to the present invention can be further increased by adding as necessary at least one element selected from the following to the above-described composition.

Cr: at most 1.0%

Cr can increase the hardenability of steel and thus increase its strength, so it can be added if necessary. However, the presence of too much Cr reduces the toughness of steel, so the upper limit on the Cr content is made 1.0%. There is no particular lower limit, but in order to increase hardenability, it is necessary to add at least 0.02% of Cr. The lower limit on the Cr content when it is added is preferably 0.1%.

Nb, Ti, and Zr: at most 0.1% each

Nb, Ti, and Zr each combine with C and N to form a carbonitride, and they are thus effective at grain refinement by the pinning effect and improve mechanical properties such as toughness, so they can be added as necessary. In order to obtain this effect with certainty, preferably at least 0.002% is added for each element. If the content of any of these exceeds 0.1%, its effect saturates, so the upper limit for each is made 0.1%. A preferred content for each is 0.01-0.05%.

Ni: at most 2.0%

Ni is an element which increases the hardenability and thus strength of steel and which also increases the toughness of steel, so it may be added as necessary. However, Ni is an expensive element and when it is added excessively, its effect saturates. Therefore, when it is added, its upper limit is made 2.0%. There is no particular lower limit, but its effect is particularly marked when its content is at least 0.02%.

V: at most 0.2%

V is an element the content of which is determined based on the balance between strength and toughness. When a sufficient strength is obtained with other alloying elements, a better toughness is obtained by not adding V. However, the addition of V causes the formation of minute carbides with Mo in the form of MC (wherein M is V and Mo), which have the effects of suppressing the formation of acicular $Mo_2C$ (which becomes the starting point of SSC), which may occur when Mo exceeds 1.0%, and increasing the quenching temperature. From this standpoint, V is preferably added in an amount of at least 0.05% and in balance with the Mo content. If too much V is added, the amount of solid solution V formed at the time of quenching reaches saturation, and the effect of increasing the quenching temperature also saturates, so its upper limit is made 0.2%.

B: at most 0.005%

B has the effect of promoting the formation of coarse grain boundary carbides $M_{23}C_6$ (wherein M is Fe, Cr, or Mo), thereby decreasing the resistance to SSC of the steel. However, B has the effect of increasing hardenability, so it can be added as necessary in a suitable range of at most 0.005% in which its effect on resistance to SSC is small and in which it can be expected to increase hardenability. In order to obtain this effect of B, it is preferably added in an amount of at least 0.0001%.

Next, a method of manufacturing a seamless steel pipe for line pipe according to the present invention will be explained. In this invention, except for heat treatment for increasing strength after pipe formation (quenching and tempering), there are no particular restrictions on the manufacturing method itself, and it can be carried out in accordance with a usual manufacturing method. By suitably selecting the chemical composition of the steel and the heat treatment conditions after pipe formation, it is possible to manufacture a seamless steel pipe having high strength with stable toughness and having good resistance to SSC even at low temperatures. Below, preferred manufacturing conditions in a manufacturing method according to the present invention will be described.

Formation of a Seamless Steel Pipe:

Molten steel which is prepared so as to have the above-described steel composition is formed by a continuous casting method, for example, into a casting having a round cross-section which can be used as a blank material for rolling (billet), or into a casting having a rectangular cross-section, from which a billet having a round cross-section is formed by rolling. The resulting billet is formed into a seamless steel pipe by piercing, elongation rolling, and sizing rolling in hot state.

The manufacturing conditions for pipe formation may be the same as the conventional manufacturing conditions for a seamless steel pipe by hot working, and there are no particular limitations thereon in the present invention. However, in order to ensure good hardenability at the time of subsequent heat treatment by shape control of inclusions, the heating temperature at the time of hot piercing is preferably at least 1150° C., and the temperature at the completion of rolling is preferably at most 1100° C.

Heat Treatment after Pipe Formation:

A seamless steel pipe manufactured by pipe formation is subjected to heat treatment in the form of quenching and tempering. The quenching method can be either a method in which a hot steel pipe as formed is initially cooled and quenching is then performed by reheating followed by rapid cooling, or a method in which quenching is performed immediately after pipe formation by rapid cooling without reheating with utilizing the heat of the hot-worked steel pipe.

When a steel pipe is initially cooled before quenching, the temperature at the completion of cooling is not restricted. The pipe may be allowed to cool to room temperature and then reheated for quenching, or it may be cooled to around 500° C. at which transformation occurs and then reheated to perform quenching, or after being cooled during transport to a reheating furnace, it may be immediately heated in the reheating furnace for quenching. The reheating temperature is preferably 880-1000° C.

The rapid cooling for quenching is preferably carried out at a relatively slow cooling rate of at most 20° C. per second (as the average cooling rate from 800° C. to 500° C. at the center of the pipe wall thickness). As a result, a bainitic-martensitic dual phase structure is formed. After undergoing tempering, steel having this dual phase structure has a high strength and high toughness, and it can still exhibit good resistance to SSC even at low temperatures where the susceptibility to SSC is increased. If the cooling rate is higher than 20° C. per second, the resulting hardened structure becomes a single martensitic phase, and resistance to SSC at low temperatures greatly decreases although strength increases. A preferred range for the cooling rate for quenching is 5°-15° C. per second. If the cooling rate is too low, quenching becomes insufficient and the strength decreases. The cooling rate in quenching can be controlled by the thickness of the steel pipe and the flow rate of cooling water.

Tempering after quenching is preferably carried out at a temperature of at least 600° C. In the present invention, since the steel has a chemical composition which contains a relatively large amount of Mo, it has a high resistance to temper softening so that it is possible to carry out tempering at a high temperature of at least 600° C., whereby it is possible to increase toughness and improve resistance to SSC. There is no particular upper limit on the tempering temperature, but normally it does not exceed 700° C.

Thus, according to the present invention, it is possible to manufacture in a stable manner a seamless steel pipe for line pipe having a high strength of X80 grade or above with high toughness and having the aforementioned value of $K_{ISSC}$ and good resistance to SSC at low temperatures due to the structure which is a bainitic-martensitic dual phase structure.

The following examples illustrate the effects of the present invention but do not in any way limit the present invention. In Examples 1 and 2, the properties were evaluated using a thick plate which had been subjected to hot working and heat treatment equivalent to the manufacturing conditions for a seamless steel pipe. The test results for a thick plate can be applied to evaluate the performance of a seamless steel pipe.

Example 1

50 kilograms of each of the steels having the chemical compositions shown in Table 1 were prepared by vacuum melting, and after heating to 1250° C., they were formed by hot forging into blocks having a thickness of 100 mm. These blocks were heated to 1250° C. and then formed by hot rolling into plates having a thickness of 40 mm or 20 mm. After these plates were maintained at 950° C. for 15 minutes, they were quenched by water cooling under the same conditions and then subjected to tempering by maintaining them for 30 minutes at 650° C. (or at 620° C. in some plates) before being allowed to cool, and the plates were then used for testing. The cooling rate during water cooling was estimated to be approximately 40° C. per second for a plate thickness of 20 mm and approximately 10° C. per second for a plate thickness of 40 mm.

TABLE 1

| | Chemical composition of steel (mass %, balance: substantially Fe) | | | | | | | | | | | | | | |
|---|---|---|---|---|---|---|---|---|---|---|---|---|---|---|---|
| No. | C | Si | Mn | P | S | Cr | Mo | Ti | V | Al | N | O | Ca | Ceq | Pcm |
| 1 | 0.047 | 0.29 | 1.52 | 0.002 | 0.001 | 0.31 | 0.2 | 0.008 | 0.04 | 0.035 | 0.001 | 0.001 | 0.002 | 0.41 | 0.17 |
| 2 | 0.047 | 0.28 | 1.53 | 0.005 | 0.001 | 0.31 | 0.5 | 0.008 | 0.05 | 0.036 | 0.001 | 0.002 | 0.002 | 0.47 | 0.19 |
| 3 | 0.05 | 0.29 | 2.05 | 0.004 | 0.001 | 0.31 | 0.7 | 0.008 | | 0.034 | 0.001 | 0.001 | 0.002 | 0.58 | 0.22 |
| 4 | 0.049 | 0.28 | 1.54 | 0.004 | 0.001 | 0.31 | 1 | 0.008 | 0.05 | 0.037 | 0.001 | 0.002 | 0.002 | 0.57 | 0.22 |

In Table 1, Ceq and Pcm are both values for C equivalents as indices to hardenability calculated by the following formulas:

$$Ceq = C + Mn/6 + (Cr+Mo+V)/5 + (Ni+Cu)/15,$$

$$Pcm = C + Si/30 + (Mn+Cu+Cr)/20 + Ni/60 + Mo/15 + V/10 + 5B.$$

The strength of each test material was evaluated by using a JIS No. 12 tensile test piece taken from the material and measuring its yield strength (YS) by a tensile test which was carried out in accordance with JIS Z 2241.

The resistance to SSC of each test material was evaluated by a DCB (Double Cantilever Beam) test. A DCB test specimen with a thickness of 10 mm, a width of 25 mm, and a length of 100 mm was taken from each test material and subjected to a DCB test which was carried out in accordance with NACE (National Association of Corrosion Engineers) TM0177-2005 method D. The test bath was an aqueous 5 wt % sodium chloride+0.5 wt % acetic acid solution saturated with 1 atm. of hydrogen sulfide gas (hereinafter referred to as bath A) at ambient temperature (24° C.) or at a low temperature (4° C.).

A specimen into which a prescribed wedge was inserted along the longitudinal center line of the specimen, thereby imposing a stress in the directions that the resulting two arms open (namely in the directions that the crack extend at the root of the arms), was immersed for 336 hours in bath A at 24° C. or 4° C. The value of stress intensive factor $K_{ISSC}$ was calculated by the following equation based on the extended crack length a of the specimen observed after immersion and the wedge releasing stress P. A test material in which the value of $K_{ISSC}$ value was at least 20.1 ksi-(in)$^{1/2}$ corresponding to a material having a YS of 80 ksi (the minimum YS for 80 ksi grade) was determined to have good resistance to SSC, and a test material in which the value of $K_{ISSC}$ value was at least 23.9 ksi-(in)$^{1/2}$ corresponding to a material having a YS of 95 ksi (the maximum YS for 80 ksi grade) was determined to have very good resistance to SSC.

$$K_{ISSC} = \frac{Pa(2\sqrt{3} + 2.38h/a)(B/B_n)^{1/\sqrt{3}}}{Bh^{3/2}} \quad \text{[Equation 2]}$$

where B is the thickness of the specimen, h is the width of each of the two arms on both sides of the crack, and $B_n$ is the thickness of the portion of the specimen in which the crack propagates.

Figure 2:
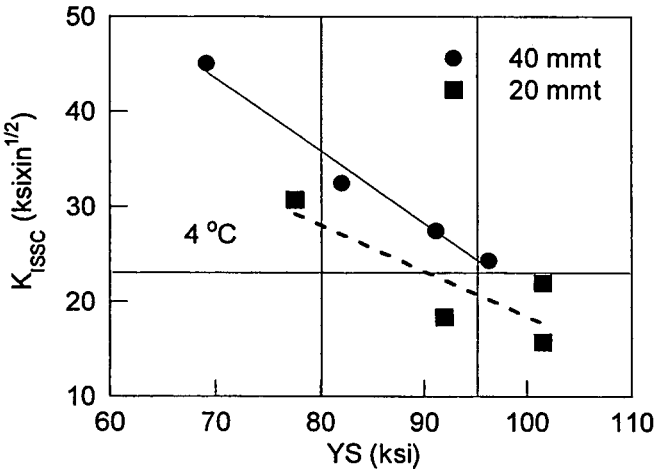
FIG. 2 is a graph showing the influence of the cooling rate in quenching on the yield strength (YS) and the stress intensive factor ($K_{ISSC}$) in which the cooling rate is varied by the thickness of a plate.

FIGS. 1 and 2 are graphs showing the results of the DCB test, with the abscissa being the YS of steel and the ordinate being the value of $K_{ISSC}$.

FIG. 1 shows the results for the 4 steels in Table 1 having an Mo content of 0.2%, 0.5%, 0.7%, and 1.0% (Steels 1-4) at a test temperature of 24° C. (open circles) and 4° C. (solid circles) for a plate thickness of both 20 mm and 40 mm. There are two of each symbol, with the one on the right side showing the result for a plate thickness of 20 mm and the one on the left showing the result for a plate thickness of 40 mm.

From FIG. 1, it was ascertained that the value of $K_{ISSC}$ (the resistance to SSC) decreases as the strength (YS) increases and the measured temperature decreases. However, for a material containing an increased amount of Mo and thus having an increased strength, a relatively high value of $K_{ISSC}$ was obtained even at a low temperature. This result means that if high temperature tempering is made possible by addition of Mo thereby increasing strength and toughness, it is possible to increase resistance to SSC.

FIG. 2 is a graph separately showing the test results for a plate thickness of 20 mm and a plate thickness of 40 mm at a test temperature of 4° C. For either plate thickness, the more the Mo content increased and the strength increased, the lower was the value of $K_{ISSC}$ (namely, resistance to SSC decreased). The influence of plate thickness at the time of heat treatment was ascertained by comparing the results for different plate thicknesses. It can be seen that a larger plate thickness at the time of heat treatment (and accordingly a slower cooling rate) gave a higher value of $K_{ISSC}$.

As shown by the results in FIG. 2, by increasing strength by the addition of Mo and by lowering the cooling rate at the time of heat treatment of the material so as to form a bainitic-martensitic dual phase structure, the value of $K_{ISSC}$ was increased. With a test material having a plate thickness of 40 mm in which the structure was the dual phase structure, it was possible to obtain a material having very good resistance to SSC at a low temperature in which the YS was 95 ksi and the value of $K_{ISSC}$ was at least 23.9 ksi-(in)$^{1/2}$.

Example 2

Example 1 was repeated using steels A-G having the chemical compositions shown in Table 2, in which the Cu content of <0.01% indicates that it is lower than the limit of detection, namely, it is an impurity. Steels A-C were materials which had a chemical composition in the range of the present invention and a plate thickness was 40 mm so that heat treatment was carried out under conditions such that the cooling rate at the time of quenching was at most 20° C. per second (the cooling rate was slow). On the other hand, Steels D-E were materials for which the chemical composition of the steel was within the range of the present invention but the plate thickness was 20 mm so that the cooling rate at the time of quenching exceeded 20° C. per second (the cooling rate was fast). Steels F-G were materials for which the plate thickness was 40 mm so that the cooling rate at the time of quenching was at most 20° C. per second but the chemical composition of the steel was outside the range for the present invention.

In this example, both the yield strength and the tensile strength were measured in the tensile test. The corrosion resistance test was carried out at 4° C. and 24° C. in the same manner as in Example 1. These test results are compiled in Table 2.

TABLE 2

| Steel | Chemical composition of steels (mass %, balance: substantially Fe) | | | | | | | | | | |
|---|---|---|---|---|---|---|---|---|---|---|---|
| mark | C | Si | Mn | P | S | Mo | Al | N | O | Ca | Cr |
| A | 0.050 | 0.30 | 1.50 | <0.012 | <0.001 | 0.5 | 0.035 | <0.005 | <0.003 | 0.002 | 0.30 |
| B | 0.050 | 0.30 | 2.00 | <0.012 | <0.001 | 0.7 | 0.035 | <0.005 | <0.003 | 0.002 | 0.30 |
| C | 0.050 | 0.30 | 1.50 | <0.012 | <0.001 | 1.0 | 0.035 | <0.005 | <0.003 | 0.002 | 0.30 |
| D | 0.050 | 0.30 | 1.50 | <0.012 | <0.001 | 0.5 | 0.035 | <0.005 | <0.003 | 0.002 | 0.30 |
| E | 0.050 | 0.30 | 2.00 | <0.012 | <0.001 | 0.7 | 0.035 | <0.005 | <0.003 | 0.002 | 0.30 |
| F | 0.050 | 0.30 | 2.50 | <0.012 | <0.001 | 0.2 | 0.035 | <0.005 | <0.003 | 0.002 | 0.30 |
| G | 0.050 | 0.20 | 1.60 | <0.012 | <0.001 | 0.4 | 0.035 | <0.005 | <0.003 | 0.002 | 0.30 |

| Steel | Chemical composition of steels (mass %, balance: substantially Fe) | | | | | | Tensile | | $K_{ISSC}$ value* ksi$\sqrt{in.}$ | |
|---|---|---|---|---|---|---|---|---|---|---|
| mark | Ti | Nb | Ni | V | Cu | Cooling rate | YS ksi | TS ksi | 4° C. | 24° C. |
| A | 0.008 | | | 0.05 | <0.01 | slow | 82.0 | 94.3 | 32.5 | 38.5 |
| B | 0.008 | | | | <0.01 | slow | 91.1 | 105.2 | 27.5 | 40.0 |
| C | 0.008 | | | 0.05 | <0.01 | slow | 96.2 | 107.9 | 24.4 | 29.7 |
| D | 0.008 | | | 0.05 | <0.01 | fast | 91.9 | 103.7 | 18.4 | 29.5 |
| E | 0.008 | | | | <0.01 | fast | 101.5 | 111.0 | 15.8 | 27.2 |
| F | 0.008 | | | 0.05 | <0.01 | slow | 84.1 | 94.6 | x | 26.0 |
| G | 0.015 | 0.020 | 0.6 | 0.03 | 0.3 | slow | 88.4 | 99.6 | x | 26.2 |

Underlined figures: Conditions outside the range defined herein;
*"x" indicates that the crack extended to go through the specimen so that the K value could not be calculated.

As shown in Table 2, for Steels A-C which are examples of the present invention, regardless of the test temperature, the value of $K_{ISSC}$ at 4° C. exceeded the value of 20.1 ksi-(in)$^{1/2}$ which is required for a material of the minimum strength level of the X80 grade steel and even exceeded the value of 23.9 ksi-(in)$^{1/2}$ which is required for a material of the maximum strength level of the X80 grade, and it was confirmed that the resistance to SSC was very good. In contrast, for Steels D and E which were comparative examples, the value of $K_{ISSC}$ at a low temperature was significantly lower than the minimum acceptable level of 20.1 ksi-(in)$^{1/2}$, indicating a significant decrease in resistance to SSC. The cause of the decrease is thought to be that the cooling rate was high, so a single martensitic phase was formed. Similarly, an extremely worsened resistance to SSC in which the crack extended to run through the specimen was found for Steel F due to Mo being inadequate, and for Steel G due to the combined addition of Mo and Cu.

With each of Steels A-C, which were examples of the present invention, the microstructure of steel was considered to be a bainitic-martensitic dual phase in view of the value of its strength. In contrast, with each of Steels D and E, it was considered to be a single martensitic phase in view of the value of its strength.

Figure 3:
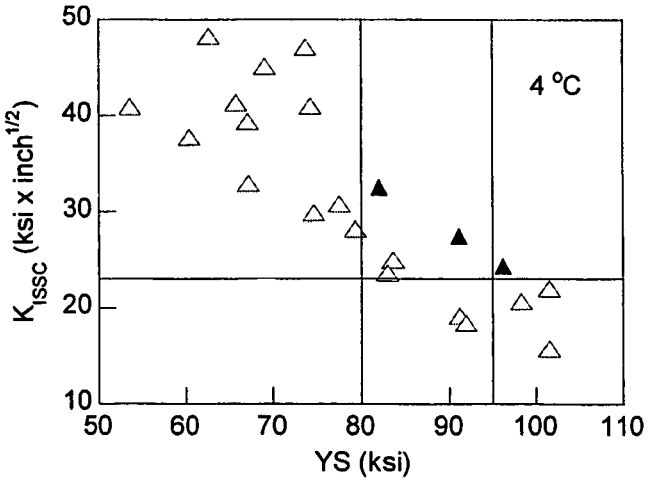
FIG. 3 is a graph showing the relationship between the yield strength (YS) and the stress intensive factor ($K_{ISSC}$) for a steel having a cooling rate in quenching of at most 20° C. per second (solid triangle) and for a steel for which it exceeds 20° C. per second (open triangle).
Figure 4:
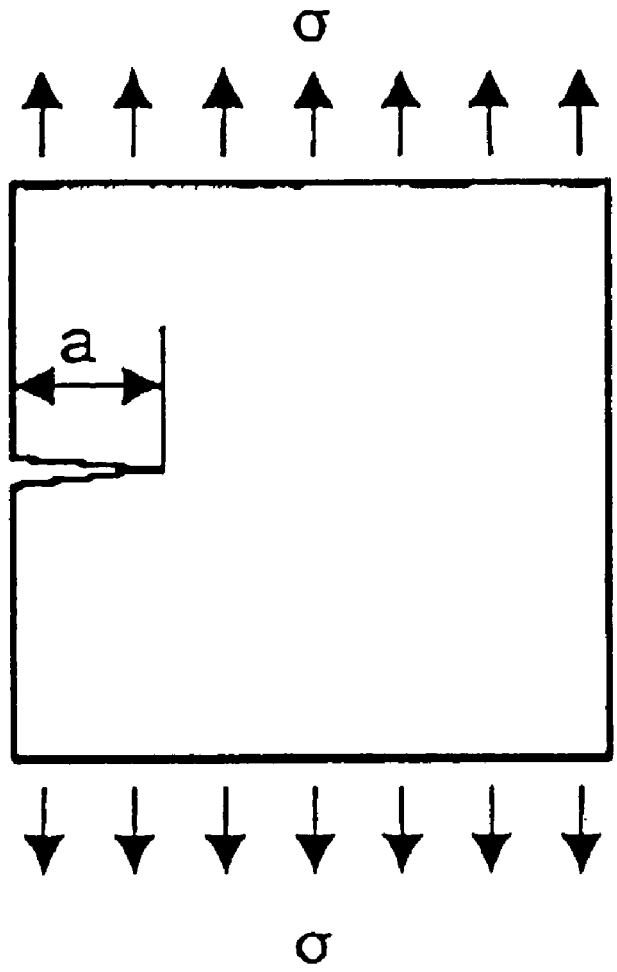
FIG. 4 is an explanatory diagram of a model showing the growth or propagation of an open-type crack.

FIG. 3 is a graph showing the value of $K_{ISSC}$ at 4° C. for many test steels including those shown in Table 2 along with the value of YS. In the figure, the solid triangles show the results for Steels A-C in order from the left (namely, examples for which the cooling rate at the time of quenching was at most 20° C. per second). The remaining open triangles are examples for which the plate thickness was 20 mm and the cooling rate was fast. When the cooling rate exceeds 20° C. per second, it can be seen that the value of $K_{ISSC}$ falls below 23.9 ksi-(in)$^{1/2}$ at the point of YS being 95 ksi which is the maximum value for 80 ksi grade steel, indicating that it is not possible to obtain a good resistance to SSC at low temperatures.

In the above examples, when the plate thickness was 20 mm, the cooling rate at the time of quenching was fast, and a bainitic-martensitic dual phase structure was not obtained, with the result that the resistance to SSC decreased. However, even if the plate thickness is 20 mm or thinner, the quenched structure can of course be made the above-described dual phase structure by controlling the flow rate of cooling water, thereby obtaining good resistance to SSC. Accordingly, the present invention is not limited to a thick-walled seamless steel pipe.

Example 3

A cylindrical steel block having the chemical composition shown in Table 3 was prepared by conventional melting, casting and rough rolling. The steel block was used as a billet (blank material for rolling), and it was subjected to piercing, drawing (elongation), and sizing in hot state in a pipe forming mill of the Mannesmann mandrel mill type to form a seamless steel pipe having an outer diameter of 323.9 mm and a wall thickness of 40 mm. Immediately after the completion of rolling, the resulting steel pipe was quenched at a cooling rate of 15° C. per second and then subjected to tempering by soaking for 15 minutes at 650° C. followed by allowing to cool. A seamless steel pipe having a YS of 82.4 ksi (568 MPa) was produced.

TABLE 3

| Chemical Composition of steel (mass %, balance: substantially Fe) | | | | | | | | | | | | | | |
|---|---|---|---|---|---|---|---|---|---|---|---|---|---|---|
| C | Si | Mn | P | S | Ni | Cr | Mo | Ti | Al | N | Cu | Ca | Ceq | Pcm |
| 0.04 | 0.27 | 1.54 | 0.006 | 0.001 | 0.02 | 0.29 | 0.74 | 0.009 | 0.036 | 0.0038 | 0.02 | 0.0025 | 0.59 | 0.22 |

In order to test for resistance to SSC, a test piece having dimensions of 2 mm in thickness, 10 mm in width and 75 mm in length was taken from a central portion in the wall thickness direction with the length of the test piece extending along the longitudinal axis of the pipe. The test bath used was an aqueous 21.4 wt % sodium chloride+0.007 wt % sodium hydrogen carbonate solution at a low temperature (4° C.) which was saturated with a mixed gas of 0.41 atm of hydrogen sulfide gas and 0.59 atm of carbon dioxide gas (referred to below as bath B).

After a strain corresponding to 90% stress of the YS of the material was imposed on the test piece by the loading method employed in a four-point bending test, the test piece was immersed in bath B for 720 hours. After being immersed, the test piece was checked if cracking (SSC) occurred, and it was found that no cracking (SSC) occurred. This result confirmed that the steel has good resistance to SSC at low temperatures also in the form of a steel pipe.

The invention claimed is:

1. The method for manufacturing a seamless steel pipe for line pipe comprising forming a seamless steel pipe in a hot state from a steel billet having a chemical composition consisting essentially of, in mass percent, C: 0.03-0.08%, Si: 0.05-0.5%, Mn: 1.0-3.0%, Mo: 0.7 to 1.0%, Al: 0.005-0.100%, Ca: 0.001-0.005%, Cr: 0-1.0%, Nb: 0-0.1%, Ti: 0-0.1%, Zr: 0-0.1%, Ni: 0-2.0%, V: 0-0.2%, B: 0-0.005%, and a remainder of Fe and impurities as N, P, S, O, and Cu, the contents of impurities being at most 0.01% for N, at most 0.05% for P, at most 0.01% for S, at most 0.01% for O, and subjecting the steel pipe to quenching in such a manner that the average cooling rate at the center of the pipe wall thickness in the temperature range from 800° C. to 500° C. is 20° C. per second or lower followed by tempering, wherein the seamless steel pipe prepared in the hot state is initially cooled to room temperature or to around 500° C. and then it is reheated to 880-1000° C. for quenching.

2. A method as set forth in claim 1 wherein the chemical composition contains, in mass percent, one or more elements selected from Cr: 0.02-1.0%, Nb: 0.002-0.1%, Ti: 0.002-0.1%, Zr: 0.002-0.1%, Ni: 0.02-2.0%, V: 0.05-0.2%, and B: 0.0001-0.005%.

3. A method as set forth in claim 1 wherein tempering is carried out at a temperature of 600° C. or higher.

* * * * *